US009731217B2

(12) United States Patent
Li et al.

(10) Patent No.: US 9,731,217 B2
(45) Date of Patent: Aug. 15, 2017

(54) DYNAMIC MULTIDIRECTIONAL FILM WATCHING SYSTEM

(71) Applicant: SHENZHEN OCT VISION INC., Shenzhen, Guangdong (CN)

(72) Inventors: Jian Li, Guangdong (CN); Hongguang Wen, Guangdong (CN); Baoluo Jia, Guangdong (CN)

(73) Assignee: SHENZHEN OCT VISION INC., Shenzhen (CN)

( * ) Notice: Subject to any disclaimer, the term of this patent is extended or adjusted under 35 U.S.C. 154(b) by 0 days.

(21) Appl. No.: 15/126,280

(22) PCT Filed: Dec. 30, 2014

(86) PCT No.: PCT/CN2014/095534
§ 371 (c)(1),
(2) Date: Sep. 14, 2016

(87) PCT Pub. No.: WO2016/090693
PCT Pub. Date: Jun. 16, 2016

(65) Prior Publication Data

US 2017/0080353 A1 Mar. 23, 2017

(30) Foreign Application Priority Data

Dec. 9, 2014 (CN) ..... 2014 2 0767832 U

(51) Int. Cl.
*A63G 31/16* (2006.01)
*A63J 5/12* (2006.01)
(Continued)

(52) U.S. Cl.
CPC ..... *A63J 5/12* (2013.01); *A63J 25/00* (2013.01); *E04H 3/22* (2013.01); *E04H 3/28* (2013.01); *E04H 3/30* (2013.01)

(58) Field of Classification Search
CPC ..... A63G 21/00; A63G 21/20; A63G 31/00; A63G 31/16; F16M 11/00; F16M 11/04; F16M 11/12; F16M 11/18
(Continued)

(56) References Cited

U.S. PATENT DOCUMENTS 6,406,299 B1 * 6/2002 Murao ..... B25J 9/104 434/29
8,147,344 B2 * 4/2012 Crawford ..... A63G 21/20 104/112
(Continued)

FOREIGN PATENT DOCUMENTS

CN 203097345 U 7/2013

OTHER PUBLICATIONS

International Search Report of PCT Patent Application No. PCT/CN2014/095534 issued on Sep. 6, 2015.

*Primary Examiner* — Kien Nguyen

(57) ABSTRACT

A dynamic multidirectional film watching system, comprising: a film watching system base; a motor arranged on the film watching system base; a film watching platform base fixedly arranged on the film watching system base; a film watching platform arranged in a rolling arrangement on the film watching platform base and comprising a plurality of rows of seats; a roller arranged on a rotation shaft of the motor; a transmission cable with one end arranged on the roller and the other end fixedly arranged on the film watching platform; and an incomplete spherical screen vertically arranged on the film watching system base, and an opening thereof facing the film watching platform. A bottom of a film watching platform is arranged in a rolling arrangement on the film watching platform base to provide audience with more dynamic and multidirectional film watching experiences.

7 Claims, 4 Drawing Sheets

(51) Int. Cl.

| | |
|---|---|
| ***E04H 3/22*** | (2006.01) |
| ***E04H 3/28*** | (2006.01) |
| ***E04H 3/30*** | (2006.01) |
| ***A63J 25/00*** | (2009.01) |
| *F16M 11/00* | (2006.01) |

(58) Field of Classification Search
USPC ..... 472/59–61, 130; 434/29, 55; 104/112, 104/113, 117, 117.1; 105/148, 150, 151
See application file for complete search history.

(56) References Cited

U.S. PATENT DOCUMENTS 8,961,326 B2 * 2/2015 Fisher ..... F16M 11/043 104/112
9,011,259 B2 * 4/2015 Schmidt ..... A63G 31/00 434/29

* cited by examiner

DYNAMIC MULTIDIRECTIONAL FILM WATCHING SYSTEM

TECHNICAL FIELD

The present disclosure relates generally to the technical field of a viewing system, and more particularly, to a dynamic multidirectional film watching system.

BACKGROUND

Fisheye lens with an ultra-wide angle can be used both for filming and showing the full dome films. The auditorium has a dome structure, and the screen is hemispherical, by which the audiences can be surrounded and the screen can be viewed as the sky. Due to the large and clear screen image extending from the front to the back of the audiences and accompanied by the surround sound, the audience would feel immersive as the spot effects are very intensive. Along with the vivid image activity, the audience would be personally on the scene involuntarily, and have very real and thrilling feelings.

However, the film watching system of the prior art normally has a horizontally arranged viewing platform, on which the audiences are seated to watch the content of the full dome films shown in front of themselves. Such kind of film watching system has a poor visual guidance, so cannot satisfy the growing demands for film viewing of the audiences. Furthermore, such kind of film watching system has such a small viewing range that the content shown below the horizontal line of the viewing platform cannot be viewed.

Therefore, the prior art has yet to be improved and developed.

SUMMARY

The object of the present application is to provide a dynamic multidirectional film watching system, aiming at the defects of the prior art that the prior film watching system has such a small viewing range that the content shown below the horizontal line of the viewing platform cannot be viewed.

In one aspect, a dynamic multidirectional film watching system is provided, which comprising: a film watching system base, a motor arranged on the film watching system base, a film watching platform base fixedly arranged on the film watching system base, a film watching platform arranged in a rolling arrangement on the film watching platform base and comprising a plurality of rows of seats, a roller arranged on a rotation shaft of the motor, a transmission cable with one end arranged on the roller and the other end fixedly arranged on the film watching platform, and an incomplete spherical screen vertically arranged on the film watching system base, and an opening thereof facing the film watching platform.

In one embodiment of the dynamic multidirectional film watching system, the incomplete spherical screen has a sectorial profile with a central angle larger than 50 degrees but smaller than 270 degrees.

In one embodiment of the dynamic multidirectional film watching system, a bottom of the film watching platform comprises a rolling surface for rolling on the film watching platform base, wherein a first gear is arranged on the rolling surface.

In one embodiment of the dynamic multidirectional film watching system, a second gear engaging with the first gear is arranged on the film watching platform base.

In one embodiment of the dynamic multidirectional film watching system, one end of the transmission cable is arranged on the roller and the other end of the transmission cable is fixedly arranged on one end of the film watching platform which is close to or far away from the incomplete spherical screen.

In one embodiment of the dynamic multidirectional film watching system, the film watching platform has an inclination angle of 0-95 degrees.

As the bottom of the film watching platform according to the present application is arranged in a rolling arrangement on the film watching platform base, such that the film watching platform can adjust an inclination angle through rolling to a best film watching angle of the audiences. As the audiences are seated on the seats arranged on the film watching platform, the seat would be suspended in the air when the film watching platform is rolled to a specific inclination angle, so as to provide the audiences with more dynamic and multidirectional film watching experiences. Meanwhile, the film watching platform system according to the present application has a simple structure and a low manufacturing cost.

DETAILED DESCRIPTION OF THE PREFERRED EMBODIMENT

The present application relates to a dynamic multidirectional film watching system. These and other advantage, aspect and novel features of the present invention, as well as details of an illustrated embodiment thereof, will be more fully understand from the following description and drawings. While various embodiments of the present invention has been presented by way of example only, and not limitation.

Figure 1:
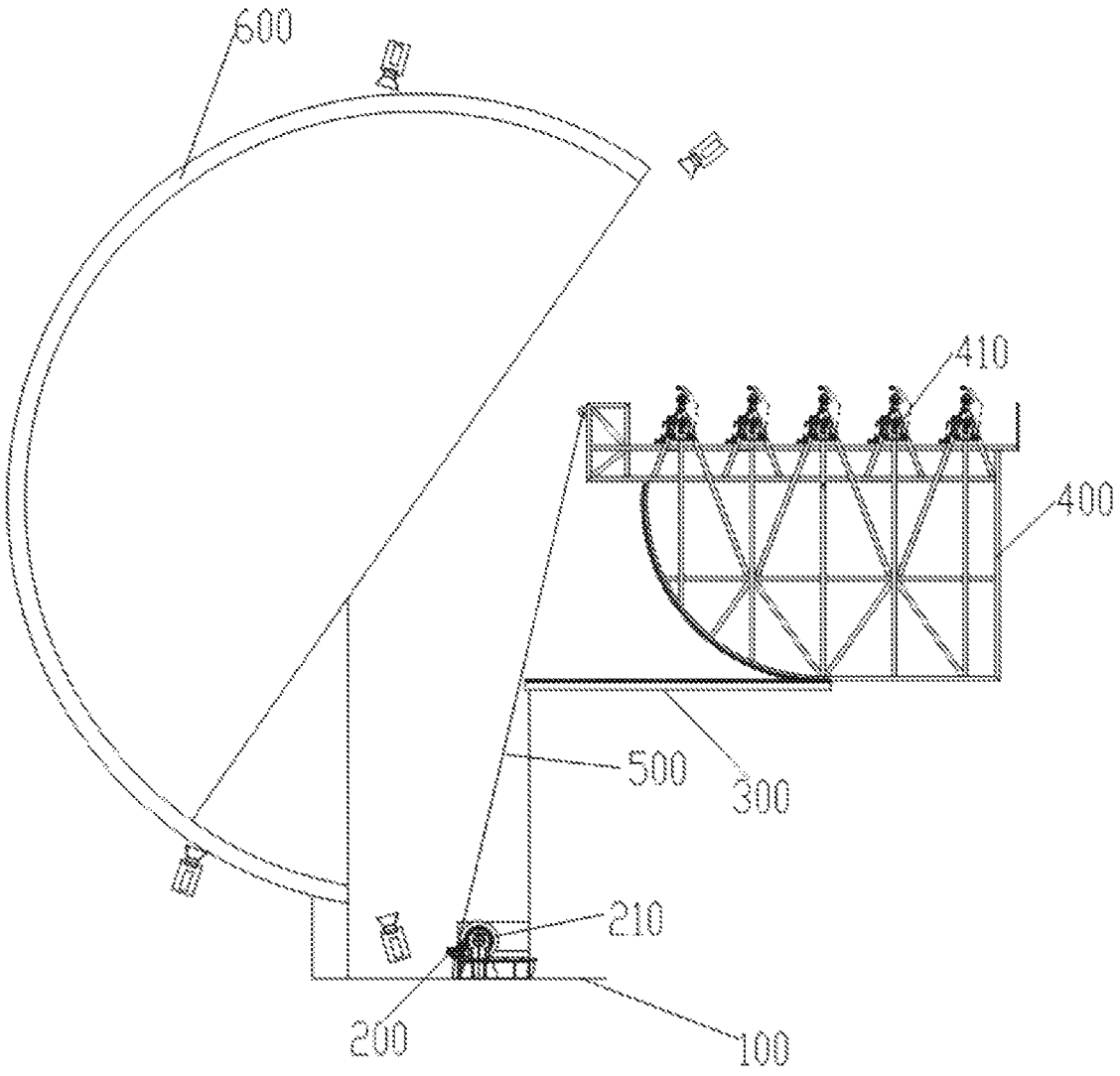
FIG. 1 is a structure diagram showing a first state of the dynamic multidirectional film watching system according to a preferable embodiment of the present application.

FIG. 1 is a structure diagram showing a first state of the dynamic multidirectional film watching system according to preferable embodiment of the present application. As shown in FIG. 1, the dynamic multidirectional film watching system comprises a film watching system base 100, a motor 200 arranged on the film watching system base 100, a film watching platform base 300 fixedly arranged on the film watching system base 100, a film watching platform 400 arranged in a rolling arrangement on the film watching platform base 300 and comprising a plurality of rows of seats 410, a roller 210 arranged on a rotation shaft of the motor 200, a transmission cable 500 with one end arranged on the roller 210 and the other end fixedly arranged on the film watching platform 400, and an incomplete spherical screen 600 vertically arranged on the film watching system base 100 and an opening thereof facing the film watching platform. The incomplete spherical screen 600 has a sectorial profile with a central angle larger than 50 degrees but smaller than 270 degrees.

The dynamic multidirectional film watching system has two embodiments when it is implemented. In the first embodiment, the end of the film watching platform 400 which is far away from the incomplete spherical screen 600 is heavy, and the other end of the film watching platform 400 which is close to the incomplete spherical screen 600 is light, that is, the gravity center of the film watching platform 400 is located at the end of the film watching platform 400 which is far away from the incomplete spherical screen 600, so the film watching platform 400 can keep horizontal automatically without an external force. Please refer to FIG. 1 again, in the first embodiment, the motor 200 is arranged at the end of the film watching platform 400 which is close to the incomplete spherical screen 600. One end of the transmission cable 500 is arranged on the roller 210 and the other end of the transmission cable 500 is fixedly arranged on one end of the film watching platform 400 which is close to the incomplete spherical screen 600.

When watching films with the dynamic multidirectional film watching system according to the first embodiment, the audiences seat on the seats 410 of the film watching platform 400 at first, and then turn on the motor 200. Then the rotation shaft of the motor 200 is controlled to rotate towards a direction in which the transmission cable 500 is wound on the roller 210. Then the rotation shaft rotates the roller such that the transmission cable 500 is wound on the roller 210. The film watching platform 400 rolls on the film watching platform base 300 towards the incomplete spherical screen 600. When the film watching platform 400 reaches a specific inclination angle, the motor 200 is stopped. The transmission cable 500 stops winging as the roller 210 stops rolling. Now, the transmission cable 500 pulls the film watching platform 400 to maintain the specific inclination angle.

In the second embodiment, the end of the film watching platform 400 which is close to the incomplete spherical screen 600 is heavy, and the other end of the film watching platform 400 which is far away from the incomplete spherical screen 600 is light, that is, the gravity center of the film watching platform 400 is located at the end of the film watching platform 400 which is close to the incomplete spherical screen 600, so the film watching platform 400 can automatically be vertical in a direction towards the incomplete spherical screen 600 without an external force. One end of the transmission cable 500 is arranged on the roller 210 and the other end of the transmission cable 500 is fixedly arranged on one end of the film watching platform 400 which is far away from the incomplete spherical screen 600. In the first embodiment, the motor 200 is arranged at the end of the film watching platform 400 which is far away from the incomplete spherical screen 600. One end of the transmission cable 500 is arranged on the roller 210 and the other end of the transmission cable 500 is fixedly arranged on one end of the film watching platform 400 which is far away from the incomplete spherical screen 600.

When watching films with the dynamic multidirectional film watching system according to the second embodiment, the motor 200 is turned on at first, and then the rotation shaft of the motor 200 is controlled to rotate towards a direction in which the transmission cable 500 is wound on the roller 210. Then the rotation shaft rotates the roller such that the transmission cable 500 is wound on the roller 210. Meanwhile, the film watching platform 400 in the vertical state is pulled to the horizontal state. Then motor 200 is turned off. After the audiences seat on the seats 410 of the film watching platform 400, the motor 200 is turned on again. Then the rotation shaft of the motor 200 is controlled to rotate towards a direction in which the transmission cable 500 is released from the roller 210. During the releasing of the transmission cable 500 by the roller 210, the pulling force acted on the film watching platform 400 by the transmission cable 500 is gradually reduced, such that the film watching platform 400 changes gradually from the horizontal state to an inclination state, and then to the vertical state. Wherein, the film watching platform 400 in the vertical state means that the angle between the film watching platform 400 and the film watching platform base 300 is about 90 degrees rather than that the angle between the film watching platform 400 and the film watching platform base 300 is just 90 degrees.

Accordingly, in both of the first and second embodiments, the film watching platform 400 can be maintained at a specific inclination angle under the pull force of the transmission cable 500, so that the audiences can be suspended in the air to watch the films from above.

In a specific implementation, a control device is arranged on the seats 410 for implementing various stunt actions along with the content of the film. As the audiences are sitting on the seats 410 arranged on the film watching platform 400 for watching the films shown by the incomplete spherical screen 600, so when the film watching platform 400 rolls to the specific inclination angle, the seats are suspended in the air. In such a way, the audiences can watch the film in a wider angle of view, and have a more dynamic and multidirectional viewing experience.

Figure 2:
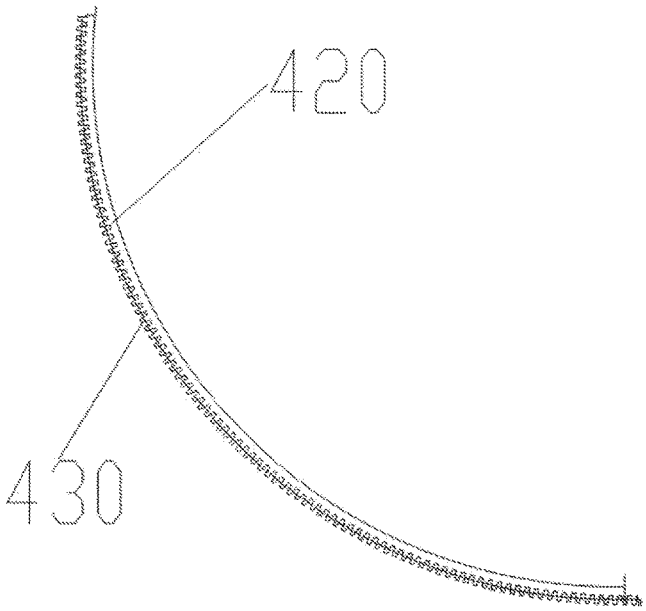
FIG. 2 is a structure diagram of the rolling surface of the film watching platform in the dynamic multidirectional film watching system according to a preferable embodiment of the present application.
Figure 3:
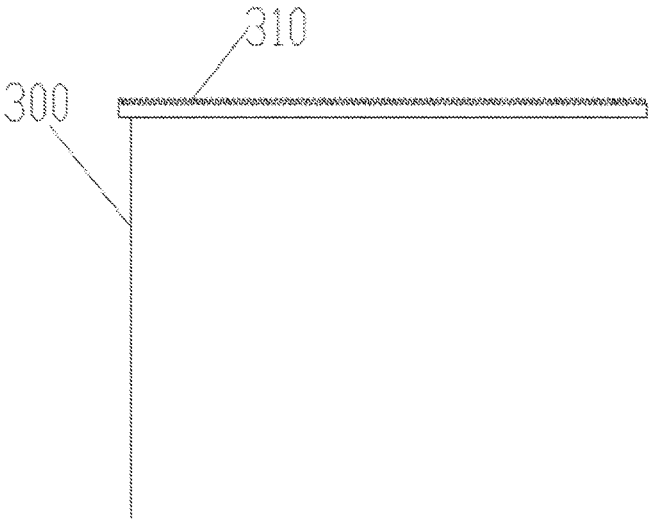
FIG. 3 is a structure diagram of the film watching platform base in the dynamic multidirectional film watching system according to a preferable embodiment of the present application.

Furthermore, as shown in FIG. 2, the bottom of the film watching platform 400 comprises a rolling surface 420 for rolling on the film watching platform base 300. A first gear 430 (gear racks arranged in an arc shape) is arranged on the rolling surface 420. Please referring FIG. 3, a second gear 310 (gear racks arranged in a plane shape) engaging with the first gear 430 is arranged on the film watching platform base 300.

In the first embodiment, when the transmission cable 500 is forced by the pulling force generated by the rotation of the roller 210, to pull the film watching platform 400 on the film watching platform base 300 to roll along a direction towards the incomplete spherical screen 600, the first gear 430 arranged on the rolling surface 430 engages with the second gear 310 arranged on the film watching platform base 300. Accordingly, the film watching platform 400 suffers a smaller resistance during the rolling. Moreover, due to the engagement of the first gear 430 and the second gear 310, when the transmission cable 500 stops pulling the film watching platform 400, the rolling surface 420 is clipped on the film watching platform base 300. In such a way, the safety of the dynamic multidirectional film watching system is improved.

In the second embodiment, due to the gravity of itself, when the transmission cable 500 wound on the roller 210 is released, the film watching platform 400 returns to the vertical state, and rolls in a direction towards the incomplete spherical screen 600. Similarly, the film watching platform 400 suffers a smaller resistance during the rolling, as the first gear 430 arranged on the rolling surface 430 engages with the second gear 310 arranged on the film watching platform base 300. Furthermore, due to the engagement of the first gear 430 and the second gear 310, when the transmission cable 500 stops pulling the film watching platform 400, the rolling surface 420 is clipped on the film watching platform base 300. In such a way, the safety of the dynamic multidirectional film watching system is improved.

Figure 4:
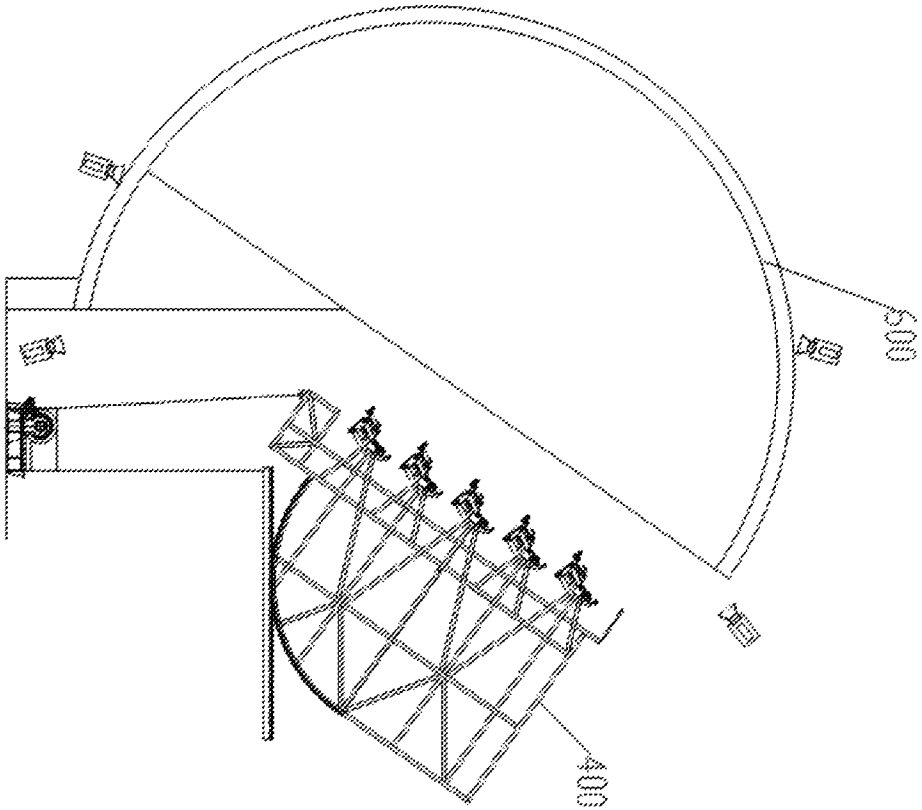
FIG. 4 is a structure diagram showing a second state of the dynamic multidirectional film watching system according to preferable embodiment of the present application.
Figure 5:
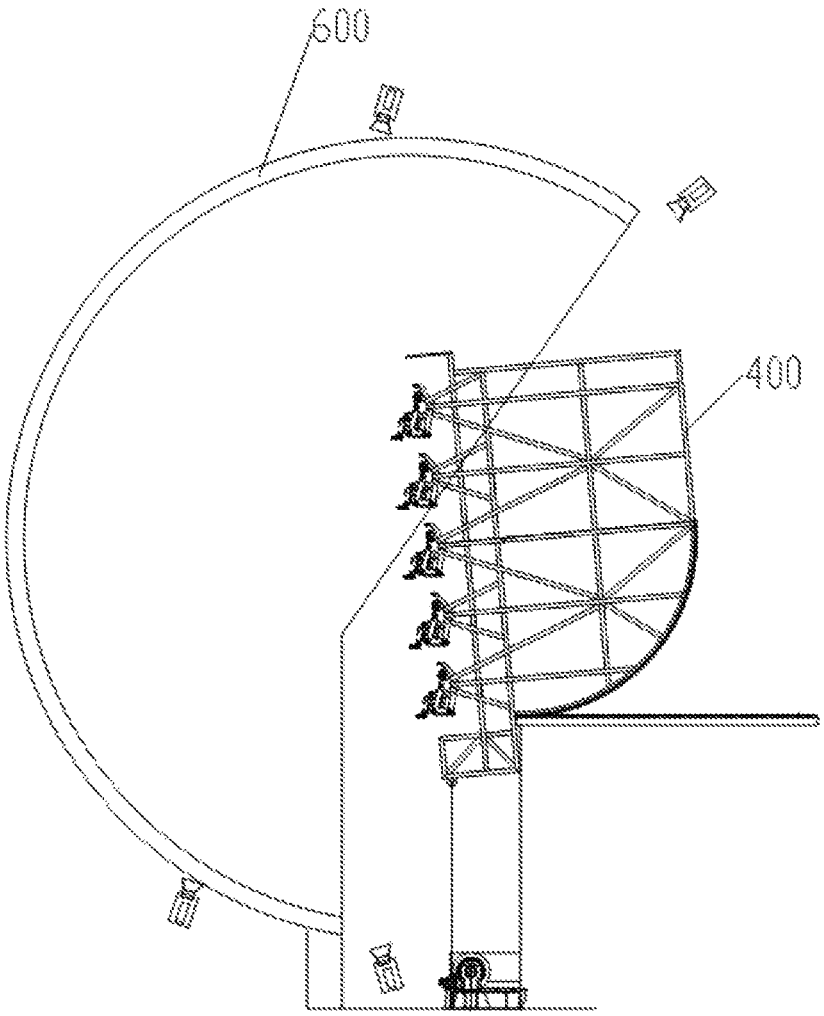
FIG. 5 is a structure diagram showing a third state of the dynamic multidirectional film watching system according to preferable embodiment of the present application.

Furthermore, the film watching platform 400 has an inclination angle of 0-95 degrees. Please refer to FIG. 4, when the film watching platform 400 is pulled by the transmission cable 500 to move in a direction towards the incomplete spherical screen 600, the film watching platform 400 has an inclination angle of 55 degrees, which is the first preferable film watching angle of the dynamic multidirectional film watching system according to the present application. Please refer to FIG. 5, when the film watching platform 400 is further pulled by the transmission cable 500 to further move in the direction towards the incomplete spherical screen 600, the film watching platform 400 has an inclination angle of 95 degrees, which is the second preferable film watching angle of the dynamic multidirectional film watching system according to the present application.

To sum up, as the bottom of the film watching platform according to the present application is arranged in a rolling arrangement on the film watching platform base, such that the film watching platform can adjust an inclination angle through rolling to a best film watching angle of the audiences. As the audiences are seated on the seats arranged on the film watching platform, the seat would be suspended in the air when the film watching platform is rolled to a specific inclination angle, so as to provide the audiences with more dynamic and multidirectional film watching experiences. Meanwhile, the film watching platform system according to the present application has a simple structure and a low manufacturing cost.

It should be noted that, the present application is not limited to above embodiments. Alternative modification and change will become apparent to those skilled in the art to which the present application pertains without departing from its spirit and scope.

What is claimed is:

1. A dynamic multidirectional film watching system comprising:

a film watching system base (100);

a motor (200) arranged at an end of the film watching platform (400) which is close to the incomplete spherical screen (600) or away from the incomplete spherical screen (600);

a film watching platform base (300) fixedly arranged on the film watching system base (100);

a film watching platform (400) arranged in a rolling arrangement on the film watching platform base (300) and comprising a plurality of rows of seats (410);

a roller (210) arranged on a rotation shaft of the motor (200);

a transmission cable (500) with one end arranged on the roller (200) and the other end fixedly arranged on one end of the film watching platform (400) which is close to or far away from the incomplete spherical screen (600);

an incomplete spherical screen (600) vertically arranged on the film watching system base (100), and an opening thereof facing the film watching platform (400); wherein the incomplete spherical screen (600) has a sectorial profile with a central angle larger than 50 degrees but smaller than 270 degrees; wherein the film watching platform (400) is maintained at a specific inclination angle under a pull force of the transmission cable (500);

a bottom of the film watching platform (400) comprises a rolling surface for rolling on the film watching platform base (300), wherein a first gear (430) is arranged on the rolling surface, and a second gear (310) engaging with the first gear (430) is arranged on the film watching platform base (300).

2. The dynamic multidirectional film watching system according to claim 1, wherein a gravity center of the film watching platform (400) is located at the end of the film watching platform (400) which is far away from the incomplete spherical screen (600); the motor (200) is arranged at the end of the film watching platform (400) which is close to the incomplete spherical screen (600); one end of the transmission cable (500) is arranged on the roller (210) and the other end of the transmission cable (500) is fixedly arranged on one end of the film watching platform (400) which is close to the incomplete spherical screen (600); wherein the rotation shaft of the motor (200) is controlled to rotate towards a direction in which the transmission cable (500) is wound on the roller (210), such that the film watching platform (400) rolls on the film watching platform base (300) towards the incomplete spherical screen (600) until the film watching platform (400) reaches the specific inclination angle.

3. The dynamic multidirectional film watching system according to claim 2, wherein the specific inclination angle is from 0-95 degrees.

4. The dynamic multidirectional film watching system according to claim 3, wherein the specific inclination angle is 55 degrees.

5. The dynamic multidirectional film watching system according to claim 1, wherein a gravity center of the film watching platform (400) is located at the end of the film watching platform (400) which is close to the incomplete spherical screen (600), one end of the transmission cable (500) is arranged on the roller (210) and the other end of the transmission cable (500) is fixedly arranged on one end of the film watching platform (400) which is far away from the incomplete spherical screen (600); wherein the rotation shaft of the motor (200) is controlled to rotate towards a direction in which the transmission cable (500) is wound on the roller (210) for pulling the film watching platform (400) from a vertical state to a horizontal state; then the rotation shaft of the motor (200) is controlled to rotate towards a direction in which the transmission cable (500) is released from the roller (210), such that the film watching platform (400) changes gradually from the horizontal state to an inclination state, and then to the vertical state.

6. The dynamic multidirectional film watching system according to claim 5, wherein the specific inclination angle is from 0-95 degrees.

7. The dynamic multidirectional film watching system according to claim 5, wherein the specific inclination angle is 95 degrees.

* * * * *